US006044880A

United States Patent [19]

Maeng

[11] Patent Number: 6,044,880

[45] Date of Patent: Apr. 4, 2000

[54] PROTECTIVE COVER FOR GOLF CLUB

[76] Inventor: Seop Maeng, 22-102, Hanyang Apartment, Songpa-Dong, Songpa-Ku Seoul, Rep. of Korea

[21] Appl. No.: 09/102,988

[22] Filed: Jun. 22, 1998

[30] Foreign Application Priority Data

Jun. 24, 1997 [KR] Rep. of Korea ..... 97-26899

[51] Int. Cl.[7] ..... A63B 57/00

[52] U.S. Cl. ..... 150/160; 206/315.2; 206/315.4

[58] Field of Search ..... 150/159, 160; 206/315.2, 315.4; 211/70.2; 16/280

[56] References Cited

U.S. PATENT DOCUMENTS

| | | | |
|---|---|---|---|
| 2,128,546 | 8/1938 | Venmore | 150/160 X |
| 4,662,415 | 5/1987 | Proutt | 150/160 |
| 4,971,126 | 11/1990 | Borenstein | 150/160 |
| 5,000,238 | 3/1991 | Zeller | 150/160 |
| 5,005,624 | 4/1991 | Sung | 150/160 |
| 5,050,884 | 9/1991 | Flory | 206/315.2 X |
| 5,284,194 | 2/1994 | Gaffney | 150/160 |
| 5,445,471 | 8/1995 | Wexler et al. | 16/280 X |
| 5,547,193 | 8/1996 | Sander | 150/160 X |
| 5,573,241 | 11/1996 | Anderson | 150/160 X |
| 5,611,379 | 3/1997 | Hoyt et al. | 150/160 |
| 5,615,720 | 4/1997 | O'Sullivan | 206/315.2 X |
| 5,738,157 | 4/1998 | Gaffney | 150/160 |

*Primary Examiner*—Sue A. Weaver
*Attorney, Agent, or Firm*—Chapman and Cutler

[57] ABSTRACT

A protective cover for a golf club has an elongated shaft protector enclosing the shaft of the club. An opening is formed along the length of the shaft protector for passing the club shaft therethrough for storage or use. This opening is closed by a hinged door. The door, either single or double, preferably pivots on a living hinge or the like formed in the material of the cover, to urge the door to its closed position but permit it to pivot inwardly and outwardly of the cover when the shaft of the club is passed inwardly or outwardly. The dimensions of the interior, the shaft, and the door are such that the door swings past the shaft to close the opening when the shaft is fully inserted. In other forms, the protective cover also includes a head cover. In one alternative form, the head cover includes a door or pair of doors for passing the head of the club in the same manner as the shaft is passed into and from the shaft protector. In another form, the bottom of the head cover is open, and the head of the club is passed through the open bottom as the shaft is inserted into the opening in the shaft protector.

14 Claims, 3 Drawing Sheets

PROTECTIVE COVER FOR GOLF CLUB

BACKGROUND OF THE INVENTION

1. Field of the Invention

The present invention relates to a protective cover for a golf club adapted to protect the head and shaft of the club.

2. Description of the Prior Art

Referring to FIG. 1, a golf bag is 21 is partitioned by internal walls 22 to receive a plurality of golf clubs therein. The golf bag 21 also has a slope at the bottom thereof so that the user can easily and conveniently extract any of golf clubs 1 from the golf bag 21 for use.

Golf clubs 1 are received in the golf bag 21 while being arranged together in parallel in such a manner that those having a shorter length are received in the front portion of the golf bag 21 whereas those having a longer length are received in the rear portion of the golf bag 21. Accordingly, the golf clubs 1 can be easily selected for use. However, when the user carries the golf bag 21, golf clubs 1 received therein will move and jostle, so that they come into contact with one another.

This is the head 2 of a shorter one of the adjacent golf clubs 1 can come into contact with the shaft 3 of the longer golf club, thereby causing the shaft 3 of the longer golf club to be scratched. The paint layer on the surface of the shaft 3 may even be peeled off. This degrades the appearance of the golf club.

In order to solve this problem, a head cover 20 as illustrated in FIG. 2 has been proposed. As shown in FIG. 2, such a head cover has a head cover portion 4 adapted to enclose the head 2 of a golf club 1, and a shaft cover portion 5 adapted to enclose the lower portion of the shaft 3 of the golf club 1 adjacent to the head 2.

This head cover 20 is put onto the golf club 1 before the golf club 1 is placed into the golf bag 21. This is done by inserting the head 2 of the golf club 1 into an opening defined at the lower end of the shaft cover portion 5 while the golf club 1 is held in an inverted state, until the head 2 is enclosed by the head cover portion 4 while the shaft 3 is enclosed by the shaft cover portion 5. Accordingly, it is possible to prevent the shaft 3 of the longer golf club 1 from being damaged due to movement occurring while carrying the golf bag, because the head cover encloses the head 2 and shaft 3. However, the opening of the head cover portion 5 has a small dimension, taking into consideration the narrow diameter (about ¼ to ½ inch) of the shaft 3 of the golf club 1. Due to such a small dimension of the opening, considerable effort is required for putting the head cover onto the golf club 1 and for taking it off. In other words, it is impossible to rapidly put the head cover onto the golf club 1 because the user must insert the head 2 of the golf club 1 into the opening of the head cover while widening the opening by hand. For taking off the head cover, a strong force is again required to extract the head of the golf club through the narrow opening of the head cover.

Furthermore, when the golf club 1, with the head cover 20, is placed into the golf bag 21, the head cover portion 5 of the head cover may come into contact, at the lower end thereof, with the heads of other golf clubs already received in the golf bag 21, the head covers of the latter golf clubs, or the upper ends of partitions 22 provided in the golf bag 21. As a result, the head cover portion 5 of the head cover may shift upwardly. Then the shaft 3 of the golf club 1 is exposed, and it may then come into direct contact with other golf clubs. For this reason, this device still permits a degradation in the appearance of the golf club shafts.

FIG. 3 illustrates another conventional head cover. This head cover has a cover body 11 adapted to enclose both the head 2 and the lower portion of the shaft 3 of a golf club 1. The cover body 11 is longitudinally slitted to allow easy insertion of the head 2 and shaft 3 of the golf club 1 into the head cover. The head cover also has a slide fastener 12 attached to the slitted portion of the cover body 11. In the case of this head cover, the slide fastener 12 attached to the cover body 11 is open for putting the head cover onto the golf club 1. Thereafter, the head 2 of the golf club 1 is inserted into the head cover through the widened opening of the head cover. After the insertion, the slide fastener 12 is closed. Thus, the head cover is put on the golf club 1, so that it protects the head 2 and the lower portion of the shaft 3. However, this head cover still has an inconvenience in that the slide fastener 12 should be manipulated to be opened and closed every time the head cover is put onto the golf club or taken off from the golf club.

Typically, the head cover is made of a thick fabric in order to provide a buffering function. For this reason, the head cover is bulky, so that it unnecessarily occupies a large space. This results in a bulky structure of the golf bag 21 itself. On the other hand, U.S. Pat. No. 5,547,193 discloses a "golf club cover." Similarly to the head cover of FIG. 1, this golf club cover disclosed in U.S. Pat. No. 5,547,193 has a head cover portion adapted to enclose the head of a golf club, and a shaft cover portion extending downwardly from the head cover portion and serving to enclose the lower portion of the shaft of the golf club. This golf club cover has a different configuration from the head cover of FIG. 1, only in that it has a longitudinal slot formed in the shaft cover portion, in order to conveniently insert the head and shaft of the golf club into the protective cover. However, this golf club cover still has an inconvenience in that the insertion of the head and shaft of the golf club into the protective cover is carried out under the condition in which the slot must be widened manually.

SUMMARY OF THE INVENTION

Therefore, an object of the invention is to solve the above mentioned problems involved in the prior art and to provide a protective cover for a golf club in which a closure member is mounted to an entrance formed on a shaft protective bar attached to a head cover member. A closure member may also be provided in the head cover member. The closure member comprises one or more doors that are hinged to achieve very accurate and rapid opening and closing operations while ensuring protection for the head and shaft of a golf club received in the protective cover against any external impacts.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, speed, convenience and ease of inserting a head and shaft into the protective cover and of removing head and shaft from the protective cover.

A first feature of the protective cover for a golf club is that it covers both the head of the golf club and the portion of the shaft immediately attached to the head. To achieve this it includes a head cover member which covers the head of the golf club and a shaft protector attached to the head cover member which covers a portion of the shaft next to the head. The head cover may have an open bottom portion which allows the head of the golf club to be inserted into the open bottom as the shaft is being inserted into the shaft entrance.

A second feature is that the shaft protector has an elongated shaft entrance therein which is substantially wider than the shaft. The shaft entrance, when placing the protective cover on the golf club, is oriented substantially parallel to the longitudinal axis of the shaft. When the head cover has an open bottom portion, the shaft protective bar has an upper end attached to one side of the cover adjacent the open bottom.

A third feature is a closure member which has a normally closed position which covers the shaft entrance. The closure member is pivotably mounted at a side of the shaft entrance by a living hinge element which returns the closure member to the closed position. The hinge element enables the closure member to move inwardly upon engaging the shaft when placing the protective cover on the golf club and to move outwardly upon engaging the shaft when removing the protective cover from the golf club. The shaft protective bar has a inner, substantially cylindrical cavity with a diameter sufficiently large so that shaft clears the closure member upon said closure member moving inward as the upon engaging the shaft when placing the protective cover on the golf club.

DESCRIPTION OF THE PREFERRED EMBODIMENTS

In FIGS. 4 to 12, protective covers for golf clubs 1 having configurations according to various embodiments of the present invention are illustrated.

Figure 1:
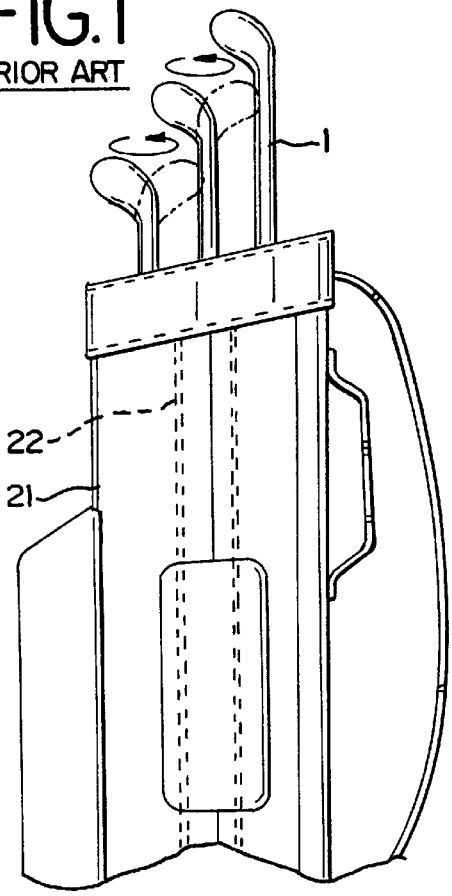
FIG. 1 PRIOR ART
FIG. 1 is a side view illustrating a state in which golf clubs are received in a golf bag in a conventional manner.
Figure 4:
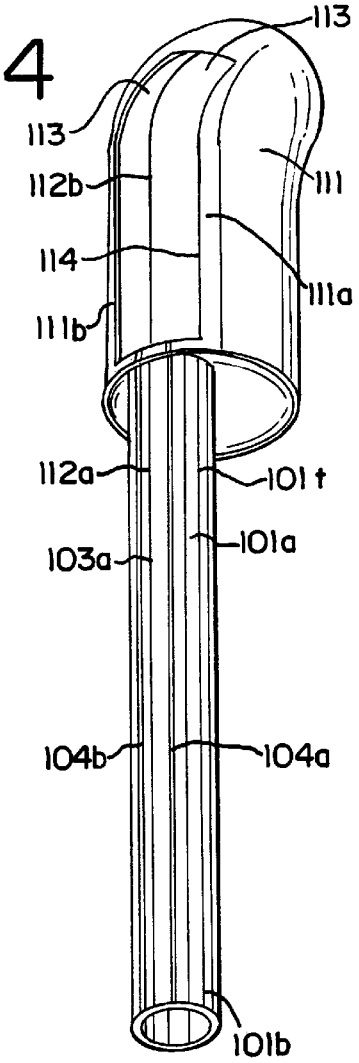
FIG. 4 is a perspective view illustrating a protective cover or a golf club according to a first embodiment of the present invention.
Figure 2:
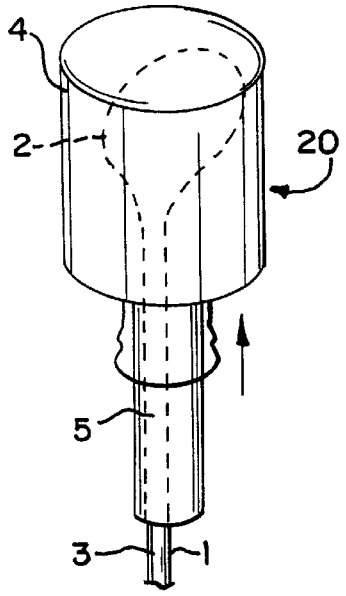
FIG. 2 PRIOR ART
FIG. 2 is a perspective view illustrating a conventional protective cover for a golf club.
Figure 3:
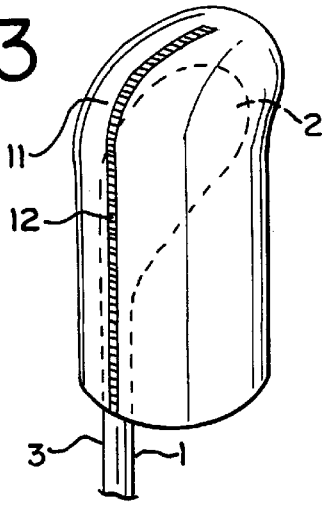
FIG. 3 PRIOR ART
FIG. 3 is a perspective view illustrating another conventional protective cover for a golf club.
Figure 5:
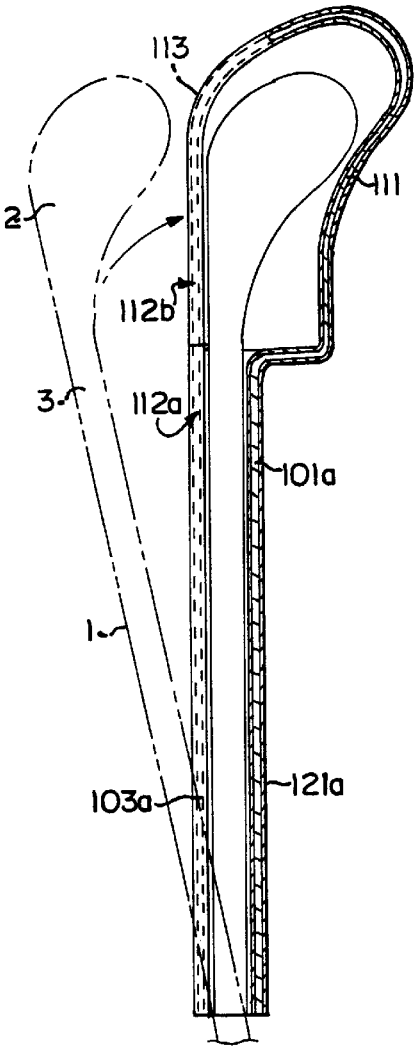
FIG. 5 is a cross-sectional view illustrating how the protective cover shown in FIG. 4 is placed onto a golf club.
Figure 6:
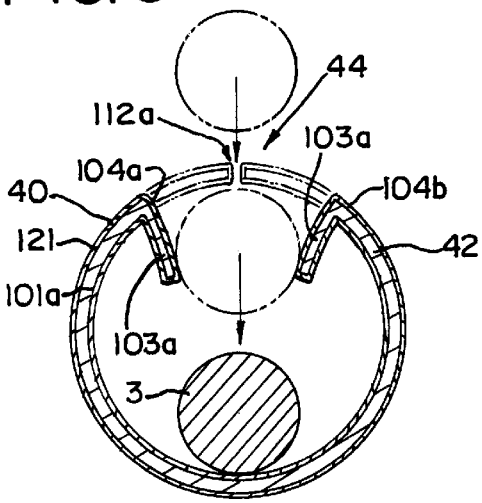
FIG. 6 is a cross-sectional view illustrating the shaft of a golf club being received in the protective cover shown in FIG. 4.
Figure 7:
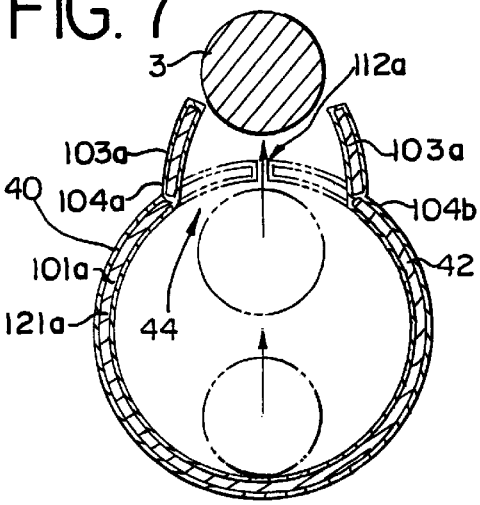
FIG. 7 is a cross-sectional view illustrating the shaft of a golf club being separated from the protective cover shown in FIG. 4.

FIGS. 4 to 7 illustrate a protective cover for a golf club according to the first embodiment of the present invention. As shown in FIG. 4, the protective cover includes a shaft entrance 112*a* formed on a shaft protector bar 101*a* for protecting a shaft 3 of the golf club 1. The shaft entrance extends along the entire length of the shaft protector bar 101 between the top 101*t* and the bottom 101*b*. A head cover 111 is attached to the top 101*t* of the shaft protector 101*a*. A pair of doors 103*a* are formed on opposite sides of the shaft entrance passage 112*a*. Each door is connected to one side of the protective cover adjacent the shaft entrance 112*a* in such a manner that each door 103*a* can be opened and closed inwardly and outwardly, as depicted in FIGS. 6 and 7.

Opening and closing of doors 103*a* are allowed by a pair of living hinges 104*a* and 104*b*. One hinge member 104*a* attaches one door 103*a* to one wall edge 40 defining one side of the shaft entrance 112*a* and the other hinge 104*b* attaches the other door 103*a* to another wall edge 42 defining the other side of the shaft entrance 112*a*. Thus, between the wall edges 40 and 42 is a gap 44 which has a at least width slightly greater than the diameter of the golf club shaft 3. These living hinges urge the doors 103*a* to their normally closed positions as shown in phantom lines in FIGS. 6 and 7 upon disengaging the shaft 3. The material from which the hinges 104*a* and 104*b* are made, for example, during injection molding, provides the tension to force the doors 103*a* to return to their closed position once the shaft 3 disengages from contact with the doors 103*a*. Alternatively, the hinge members 104*a* and 104*b* may be provided with a spring (not shown) to provide the force needed to return the doors 103*a* to their closed position once the shaft 3 disengages from contact with them.

The protective cover 111 includes a head entrance 112*b* formed on a head cover 111 for protecting the head 2 of the golf club 1, a pair of doors 113 connected by living hinges 114 to the both sides of the head entrance 112*b* in such a manner that the doors 113 can be opened and closed inwardly and outwardly in a manner essentially identically to the doors 103*a* upon these doors 113 engaging the head 2 of the golf club 1. The hinge members 114 are connected in such a manner to each door 113 and the side wall edges 111*a* and 111*b* of the head cover member 111 to provide the force needed to return these doors to a normally closed position when not engaging the head 2.

A lining 121 is attached over the inner and outer surfaces of the shaft protector 101*a* and the inner and outer surfaces of the head cover member 111. The lining 121 serves to cushion the shaft protector 101*a* and the head cover member 111 against any external impact. The lining 121 also prevents the head and shaft of the golf club received in the protective cover from being scratched by the inner surfaces of the shaft protector 101*a* and the head cover member 111.

Figure 8:
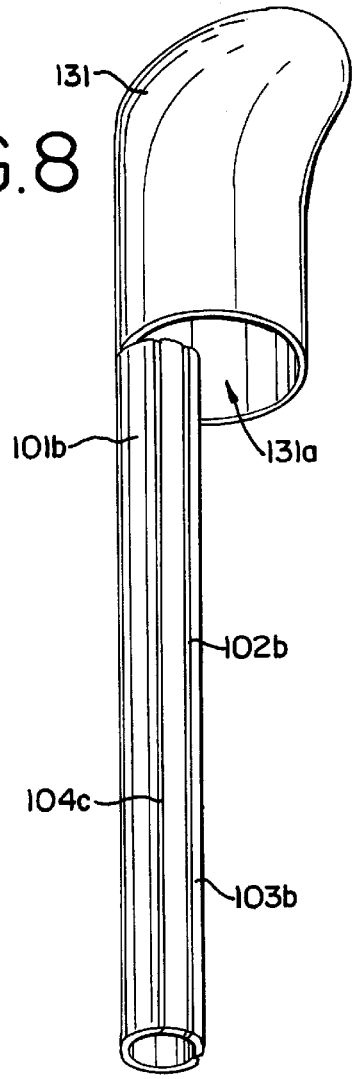
FIG. 8 is a perspective view illustrating a protective cover according to a second embodiment of the present invention.
Figure 9:
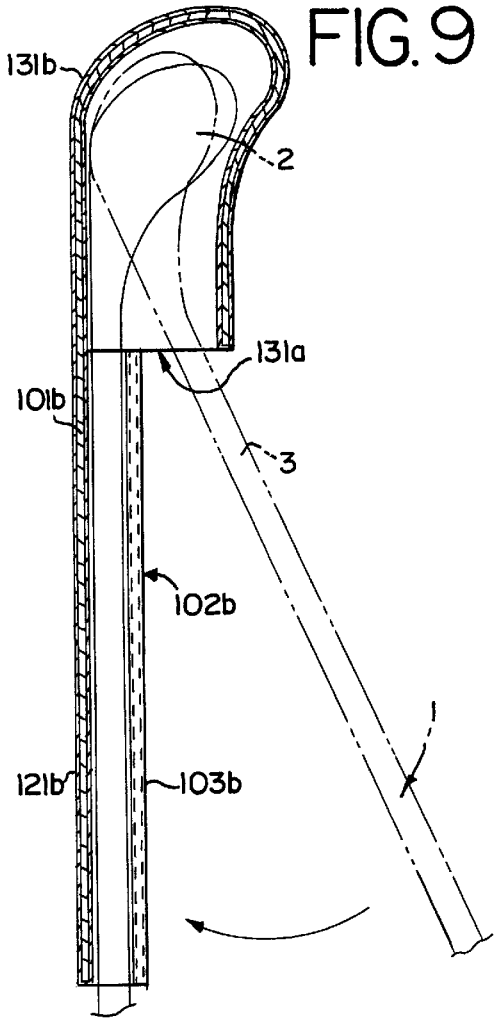
FIG. 9 is a side cross-sectional view illustrating placing the protective cover shown in FIG. 8 onto a golf club.

FIGS. 8 and 9 illustrate a protective cover for a golf club according to the second embodiment of the present invention. A head cover member 131 is attached to an upper portion of a shaft protector 101*b*. Unlike the first embodiment shown in FIGS. 4 through 7, in this second embodiment there is no head entrance passage 112 in its head cover 131. In this second embodiment, the head cover 131 has an open bottom 131*a* into which the head 2 of the golf club is inserted as depicted in FIG. 9. The shaft protector 101*b* is similar to that shown in the first embodiment.

Figure 10:
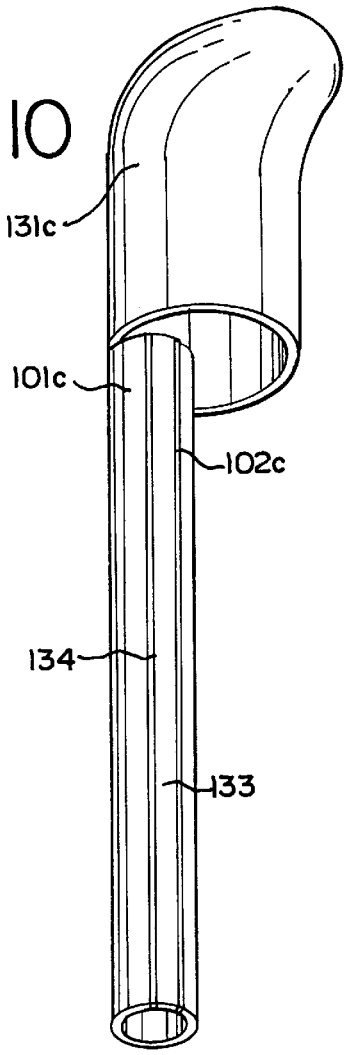
FIG. 10 is a perspective view illustrating a protective cover according to a third embodiment of the present invention.
Figure 11:
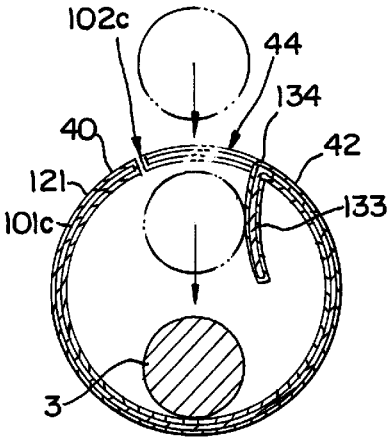
FIG. 11 is a cross-sectional view illustrating the shaft of a golf club being received in the shaft protector bar shown in FIG. 10.
Figure 12:
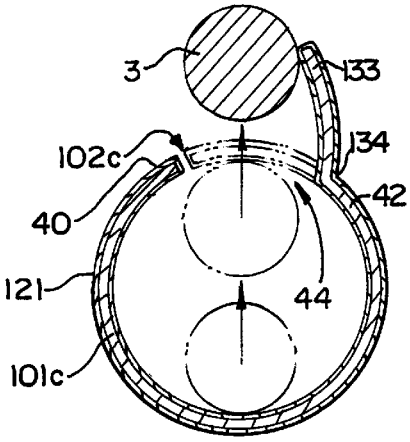
FIG. 12 is a cross-sectional view illustrating the shaft of a golf club being separated from the shaft protector bar shown in FIG. 10.

In the embodiment of the present invention shown in FIGS. 10 through 12, the protective cover includes only one door 133 connected to only one side 42*b* of the shaft entrance passage 112*a*. This door 133 is mounted by a hinge 134 to open and close inwardly and outwardly, and is sufficiently long to cover the entire gap 44 between the wall edges 40 and 42.

Hereinafter, an operation of the present invention will be described with reference to the accompanying drawings.

In the first embodiment, the protective cover is attached and detached through means of the shaft protector 101*a* and the head cover member 111 by operation of the door 103*a* and 113 engaging the golf club 1. That is as best illustrated in FIG. 5, with the golf club 1 inverted and standing with a slant angle, the lower portion of the shaft 3 of the golf club 1 is inserted side way through the lower portion of the shaft entrance 112*a* of the shaft protector bar 101*a*, and this lower portion of the shaft 3 is pushed inwardly toward the head cover 111 gradually. The shaft 3 first pushes the plates 103 inward, and then pushes the plates 113 of the head cover 11 inward.

Since the doors 103*a* are connected to the shaft protector bar 101*a* by the living hinge members 104*a* and 104*b*, each door 103*a* is rotated toward an inner portion of the shaft protector 101*a*, as shown in FIG. 6, in a straight line, by the force occurring with the insertion of the shaft 3, so that the shaft entrance 112*a* is opened. Thereafter, when completing the insertion of the shaft 3, these door 103*a* are closed, as shown in FIG. 6 in phantom lines, by the tension or return force of the hinge members 104*a* and 104*b*. Accordingly, the shaft 3 is inserted into the shaft protector 101*a* , moving gradually from its lower portion towards the head cover 111. When completing the insertion of the shaft 3 in the shaft protective bar 101, the head 2 is inserted into the head cover member 111. The head 2 pushes the doors 113 open and passes through the head entrance 112*b* and then is inserted into the inner portion of the head cover member 111, all as shown in FIG. 5. And, since the upper doors 113 are connected to the head cover member 111 and by second hinges 114, the doors 113 are rotated toward an inner portion of the head cover member 111 by the force upon the insertion of the head 2, so that the head entrance 112*b* is opened. Thereafter, when completing the insertion of the head 2 is completed and the entrance passage 112*b* is closed by tension of the hinges 114, the same as the operation of the doors 103*a*.

The protective cover of FIGS. 4–7 is removed by pulling the shaft 3 and head 2, respectively through the shaft entrance passage 112*a* and head entrance passage 112*b*. That is, a user catches the shaft protector 101*a* in one hand and the shaft 3 in the other hand and pulls the lower portion of the shaft 3, so that the shaft 3 is taken from the lower portion of shaft entrance passage 112*a* of the shaft protector 101*a*. At this time, the doors 103*a* are rotated by the force occurring by the movement of the golf shaft 3, and the shaft 3 is separated from the protective cover as shown in FIG. 7. At the same time as the shaft 3 is removed from the shaft protector 101*a*, the head 2 of the golf club 1 is separated from the protective cover, by pushing against the doors 113 blocking the head entrance passage 112*b*. Accordingly, the golf club 1 can be easily removed from the shaft protector 101*a* and the head cover 111.

To use the protective cover shown in FIGS. 8 and 9, the user stands the golf club 1 at a slight angle and inserts the head 2 of the golf club 1 into the open bottom 131*a* of the head cover member 131*b*. The upper portion of the shaft 3 is pushed sidewardly as shown into the upper portion of the shaft entrance passage 102*b* formed on the shaft protector 102*b*.

The shaft 3 of the golf club 1 being inserted into the inner portion of the shaft protector bar 102*b* through the shaft entrance passage 102*b* first pushes the doors 103*b* open. Since the doors 103*b* are connected to the shaft protector 102*b* by the first hinge members 104*a* and 104*b*, the doors 103*b* are rotated toward an inner portion of the shaft protector 102*b* by the force occurring during the insertion of the shaft 3, so that the shaft entrance passage 102*b* is opened. Thereafter, when completing the insertion of the shaft 3, the doors 103*b* are closed by force of the hinges 104*a* and 104*b*. When removing the golf club 1 from the cover after separating the shaft 3 from the shaft protector 101*b*, the head 2 is separated from the head cover member 131.

FIGS. 10 to 12 illustrate the third embodiment of the present invention, a protective cover with only one door 133. The door 133 is pushed inward as shown in FIG. 11 as the golf club shaft 3 is inserted. When removing the shaft 3 from the protective cover, the door 133 is pushed outward as shown in FIG. 12.

As is apparent from the above description, the present invention provides a protective cover for a golf club in which at least one door is mounted across an entrance formed on a shaft protector. A head cover with a similar entrance for the head of the golf club may be provided with at least one door, or alternatively with a bottom opening for inserting the head. Each door is urged to its closed state, thereby achieving very accurate and rapid opening and closing operations while ensuring a protection for the head and shaft of a golf club received therein against an external impact. Since the protective cover can be rapidly opened and closed, it provides a convenient manner of inserting and removing the head and shaft of the golf club. That is, the protective cover of the present invention completely eliminates the problems involved in conventional protective covers. In addition, since the protective cover of the present invention can be made of a synthetic resin material, its structure is light. Furthermore, easy manufacture is achieved. Accordingly, mass production is possible.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

What is claimed is:

1. A protective cover for portions of a golf club, the cover being elongated for extending along a shaft of the club and being formed to encircle the shaft along a portion of its length and having a hollow, elongated interior formed within said cover, the cover comprising:

a passage formed radially through said cover and into said interior, the passage extending along the length of the shaft cover from a top to a bottom thereof;

at least one pivotable door formed in the cover and integrally therewith via a living hinge joining the door to the cover along a line spaced evenly from said passage, the door thereby being urged to a closed position encircling the shaft of the club but being displaceable therefrom inwardly of the cover and outwardly of the cover for passing the shaft of the golf club into and from the interior of the cover for storage and for use, respectively.

2. The protective cover of claim 1, wherein the cover comprises a pair of pivotable doors, one on either side of the passage.

3. The protective cover of claim 1, wherein the cover further comprises a hollow cover for the head of the golf club, the head cover being affixed to the top of the shaft cover.

4. The protective cover of claim 1, wherein the protective cover includes a fabric portion on an interior thereof.

5. The protective cover of claim 1, further comprising a cushioning fabric applied over interior and outside surfaces of the cover, whereby to further protect the shaft of the golf club from scratching from the interior of the cover and from damage from external impacts.

6. A protective cover for portions of a golf club, the cover comprising:

a shaft protector having a passageway opening formed therein and extending along the protector, the passageway opening receiving a shaft of the club thereinto;

the passageway opening extending substantially radially through the protector to an interior of the cover formed within the protector;

at least one door formed in the cover by a living hinge spaced from and parallel to the passageway opening in the cover, the door pivoting inwardly and outwardly from the protector for passing the shaft of the club respectively into and out of the cover, and the hinge urging the door into a position closing the passageway and minimizing the opening.

7. The protective cover of claim 6, further comprising a second door formed from the protector by a living hinge spaced from and parallel to the passageway opening opposite the one door, the second door also pivoting inwardly and outwardly from the protector for passing the shaft of the club respectively into and out of the cover, and the hinge urging the second door into a position closing the passageway and minimizing the opening.

8. A protective cover for portions of a golf club, the cover comprising:

a head protector having a passageway opening formed therein and extending along a part of the head protector, the passageway opening receiving the head of the club thereinto;

a shaft protector connected to the head protector and having a passageway opening formed therein and extending along the protector, the passageway opening receiving a shaft of the club thereinto;

the passageway openings extending substantially radially through the protector to an interior of the cover formed within the protector; and at least one door formed in the cover by a living hinge spaced from and parallel to the passageway opening in the cover, the door pivoting inwardly and outwardly from the protector for passing at least one of the head and shaft of the club respectively into and out of the cover, and the hinge urging the door into a position closing the passageway and minimizing the opening.

9. The protective cover of claim 8, wherein each of the passageways in the head protector and in the shaft protector portions has a door pivoting on a living hinge, and the doors are aligned lengthwise along the cover to accept the shaft and head of the club therethrough.

10. The protective cover of claim 8, wherein a pair of doors is formed along at least one of the passageway openings in the head protector and the shaft protector, each of said doors being formed in the cover by a living hinge spaced from and parallel to the passageway opening in the cover, each of said pair of doors pivoting inwardly and outwardly from the protector for passing at least one of the head and shaft of the club respectively into and out of the cover, and each hinge for each of said pair of doors urging its respective door into a position closing the passageway and minimizing the opening.

11. The protective cover of claim 8, further comprising a cushioning fabric applied over interior and outside surfaces of the cover, whereby to further protect the head and shaft of the golf club from scratching from the interior of the cover and from damage from external impacts.

12. A protective cover for portions of a golf club having a head attached to a shaft, the cover comprising:

a head cover member which encloses the head of the golf club, an elongated shaft cover member which is attached to the head cover member and covers a portion of the shaft of the golf club adjacent the head, the shaft cover member having an elongated shaft entrance formed therein along its length, the entrance being wider than the shaft for accepting the shaft therethrough in sideways fashion, a closure member normally closing the shaft entrance and being pivotally mounted to one side of the entrance by a hinge, the hinge urging the closure member to its normally closed position but permitting the member to pivot inwardly of the cover member for accepting the shaft and to pivot outwardly for permitting removal of the shaft from the cover.

13. The protective cover of claim 12, wherein the head cover member has an open bottom portion adjacent the shaft cover member, thereby permitting the golf club head to be inserted into the cover through said bottom portion as the shaft is inserted sidewardly into the shaft entrance.

14. The protective cover of claim 12, wherein the shaft cover member has an interior space sufficiently large to permit the closure member to pivot shut after passage of the shaft of the club into said cover.

* * * * *